US005150676A

United States Patent [19]

Brevick et al.

[11] Patent Number: 5,150,676

[45] Date of Patent: Sep. 29, 1992

[54] SEALED MACHINED MEMBER

[75] Inventors: John E. Brevick, Livonia; Steven P. Bittner, Flint; Briant J. Kling, Redford, all of Mich.

[73] Assignee: General Motors Corporation, Detroit, Mich.

[21] Appl. No.: 773,163

[22] Filed: Oct. 8, 1991

[51] Int. Cl.[5] ..... F02F 7/00

[52] U.S. Cl. ..... 123/195 R

[58] Field of Search ..... 123/195 R, 195 C

[56] References Cited

U.S. PATENT DOCUMENTS 3,983,852 10/1976 Chatourel ..... 123/41.69

4,721,077 1/1988 Fukuo et al. ..... 123/195 R

*Primary Examiner*—Noah P. Kamen

*Attorney, Agent, or Firm*—Gordon F. Belcher

[57] ABSTRACT

A sealed machined member comprises a casted block member having an outer surface including a machined portion and a scalloped portion which adjoins the machined portion. The scalloped portion is cast into the outer surface when the block member is casted. A wet passage is formed in the block member for containing fluid having a pressure which is greater than the pressure adjacent to the outer surface. The wet passage has a longitudinal axis which defines a passage plane. The passage plane extends between the longitudinal axis of the wet passage and the part of the outer surface nearest to the wet passage. The scalloped portion is oriented so that its longitudinal axis lies in the passage plane. The scalloped portion is recessed from the outer surface so that the scalloped portion is not machined when the outer surface is machined.

3 Claims, 1 Drawing Sheet

SEALED MACHINED MEMBER

TECHNICAL FIELD

This invention relates to a sealed machined member having a wet passage for contained pressurized fluid, and more particularly to a casted block member having an outer surface with a scalloped portion near the wet passage which avoids being machined when a portion of the outer surface is machined.

BACKGROUND

A casted block member can have a wet passage which contains pressurized fluid. It is therefore preferable that the material of such a block member have a low porosity to obstruct seepage of oil from the wet passage through the block member to its outer surface. It is particularly desirable that the block member have a low porosity in the region between the wet passage and the portion of the outer surface which is closest to the wet passage. This is due to this portion of the block member providing the shortest path between the wet passage and the outer surface.

When such a block member is casted, the skin of its outer surface which directly contacts the internally cooled die steel typically has a low porosity. This casted skin of the outer surface can be removed during machining o the outer surface to expose a surface which, prior to the machining, was unexposed. A portion of the block member which was unexposed. A portion of the block member which was unexposed during the casting process can have a higher porosity (and lower resistance to seepage through the block member) than a surface which directly contacted the die steel during casting. Thus, it is desirable to not remove the casted skin, particularly in the vicinity of the wet passage, since the casted skin increases resistance of the block member to oil seepage from the wet passage through the block member to the outer surface.

SUMMARY OF THE INVENTION

The present invention provides a sealed machined member comprising a casted block member having an outer surface including a machined portion and a scalloped portion which adjoins the machined portion. The scalloped portion is cast into the outer surface when the block member is casted. A wet passage is formed in the block member for containing fluid having a pressure which is greater than the pressure adjacent to the outer surface. The wet passage has a longitudinal axis which defines a passage plane. The passage plane extends between the longitudinal axis of the wet passage and the part of the outer surface nearest to the wet passage. The scalloped portion is oriented so that its longitudinal axis lies in the passage plane. The scalloped portion is recessed from the outer surface so that the scalloped portion is not machined when the outer surface is machined.

The orientation of the scalloped portion results in the skin of the outer surface which is closest to the wet passage being undisturbed even when the machined portion is machined. Seepage through the shortest path between the wet passage and the outer surface is thereby obstructed by the casted skin covering the scalloped portion.

BRIEF DRAWING DESCRIPTION

In the drawings: FIG. 1 is a perspective view of an embodiment of a sealed machined member of the present invention included as part of a lower crankcase of an engine;

FIG. 2 is an end view of the lower crankcase generally in the plane indicated by line 2—2 of FIG. 1 showing the sealed machined member transversely spaced along the length of the crankcase, and the crankshaft in phantom; and FIG. 3 is a plan view of the sealed machined member generally in the plane indicated by line 3—3 of FIG. 2 showing the machined and scalloped portions, and the crankshaft in phantom. Corresponding reference characters indicate corresponding parts throughout the several views of the

DETAILED DESCRIPTION

Figure 1:
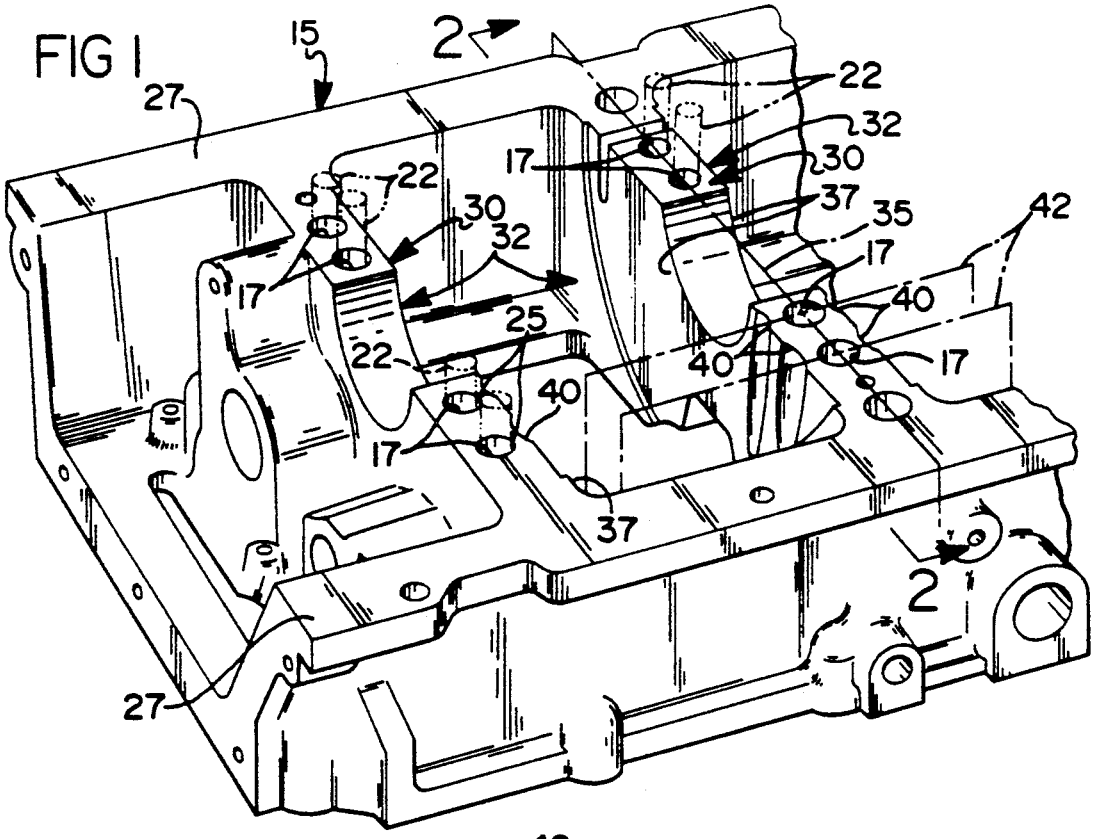

Referring to the drawings and particular FIG. 1, numeral 15 generally refers to a lower crankcase of an engine block for a V-type engine. The engine block also includes an upper crankcase. The cylinder bores are formed in the upper crankcase with a piston being contained in each of the cylinder bores. Formed in the lower surface of the upper crankcase are longitudinally spaced semicircular recesses. Each of these semicircular recesses has an upper half of a main bearing mounted in it. Also formed in the lower surface of the upper crankcase are elongated recesses, each of which extends away from a respective semicircular recess in which an upper half of a main bearing is mounted. These elongated recesses extend toward the side of the upper crankcase.

Figure 2:
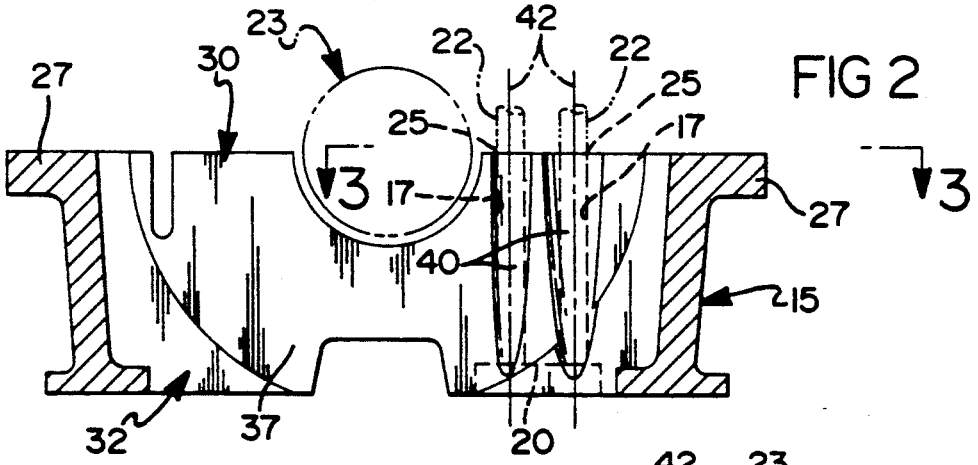
Figure 3:
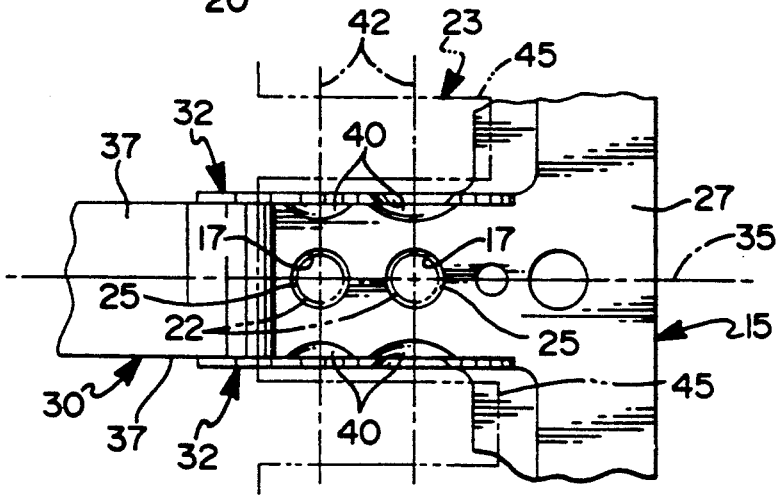

The lower crankcase 15 is a rectangular casted structure having side members 27 connected by a plurality of transverse block members 30, as shown in FIG. 2. The block members 30 contain crankcase bolt holes in which crankcase bolts 22 extend enabling attachment of the lower crankcase 15 to the upper crankcase.

Each crankcase bolt hole 17 is sized so that there is a clearance between its walls and the crankcase bolt 22 which extends through it. Some of these clearances are used as conduits for lubricating oil with such clearances constituting wet passages 25. The lower crankcase 15 is attached to the upper crankcase. The wet passages 25 register with recesses or openings in the lower surface of the upper crankcase through which oil is carried. Examples of such recesses in the lower surface of the upper crankcase are the recesses which extend away from the upper half of the main bearings. These recesses in the lower surface of the upper crankcase are closed when the lower crankcase 15 mates with the upper crankcase to form passages.

Recesses 20 are formed in the lower surface of the lower crankcase 15. These recesses have branches which intersect the wet passages 25. A crankcase plate is attached to the lower surface of the lower crankcase 15 to enclose these recesses to form passages. The upper surface of the lower crankcase 15 also has semicircular recesses in which the lower halves of the crankshaft bearings are mounted. Attachment of the lower crankcase 15 to the upper crankcase results in the upper and lower halves of the crankshaft bearings mating with one another to form circular supports which rotatably support the crankshaft 23.

The passage bounded by the recess 20 in the lower surface of the lower crankcase 15 is supplied with pressurized oil. The oil flows from this passage into the wet passages 25. From the wet passages 25, the oil flows into the passages bounded by the recesses in the lower surface of the upper crankcase which extend to the upper halves of the main bearings. The oil then circulates throughout the main bearings for lubrication. Oil in the wet passages 25 may also flow into other openings in the lower surface of the upper crankcase through which oil is carried.

Block members 30 have outer surfaces 32 which face one another and extend between the side members 27. Each pair of outer surfaces 32 which sandwich a respective block member 30 are inclined towards one another in an upward direction resulting in the thickness of the upper surface of each block member 30 being slightly smaller than the thickness of its lower surface. Each such pair of outer surfaces 32 are inclined approximately one degree with respect to a plane 35 which contains the axes of all of the bolt holes 17 in the respective block member 30.

Each outer surface 32 includes a machined portion 37 and a concave scalloped portion 40 which adjoins the machined portion. The machined portion 37 of each block member 30 is parallel to the plane 35 of the block member 30 on which it is formed. Each scalloped portion 40 is casted into the outer surface 32 by cylindrical dies when the lower crankcase 15 is casted. The axis of the cylindrical dies is parallel to plane 35. The conical shape of each scalloped portion 40 is caused by the inclination of the outer surfaces 32.

Each wet passage 25 has a longitudinal axis which defines a passage plane 42. Each passage plane 42 extends between the longitudinal axis of the wet passage 25 and the part of the outer surface 32 nearest to the wet passage. The scalloped portion 40 is oriented so that its longitudinal axis lies in the passage plane 42.

The machined portions 37 are sufficiently machined so that the counterweights 45 of the crankshaft 23, during rotation of the crankshaft 23, do not contact the outer surfaces 32. Each scalloped portion 40 is recessed from the outer surface 32 so that the scalloped portion is not machined when the outer surface 32 is machined during formation of the adjoining machined portion 37.

When the engine is operated, the oil in the wet passages 25 has a pressure which is greater than the pressure adjacent to the outer surfaces 32. It is therefore preferable that the material of the block members 30 have a low porosity to obstruct seepage of oil from the wet passages 25 through the block members 30 to the outer surfaces 32. It is particularly desirable that block members 30 have a low porosity in the region between the wet passages 25 and the portions of the outer surfaces 32 which are closest to the wet passages. This is due to these portions of the block member 30 providing the shortest path between the wet passages 25 and the outer surfaces 32.

When the lower crankcase 15 is casted, the skins of the outer surfaces 32 which directly contact the internally cooled die steel typically have a low porosity. This casted skin of the outer surfaces 32 can be removed during the machining of the machined portions 37 to expose surfaces which, prior to the machining, were unexposed. Portions of the block members 30 which were unexposed during the casting process can have a higher porosity (and lower resistance to seepage through the block member) than surfaces which directly contacted the die steel during casting. Thus, it is desirable to not remove the casted skin, particularly in the vicinity of the wet passages 25, since the casted skin increases resistance of the block members 30 to oil seepage from the wet passages 25 through the block members to the outer surfaces 32.

The orientation of the scalloped portions 40 results in the skin of the outer surfaces 32 which is closest to the wet passages 25 being undisturbed even when the machined portions 37 are machined. Seepage through the shortest path between the wet passages 25 and the outer surfaces 32 is thereby obstructed by the casted skin covering the scalloped portions 40.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property or privilege is claimed are defined as follows:

1. A sealed machined member comprising:

a casted block member having an outer surface including a machined portion and a scalloped portion which adjoins said machined portion, said scalloped portion being cast into said outer surface when said block member is casted;

a wet passage formed in said block member for containing fluid having a pressure which is greater than the pressure adjacent to the outer surface, said wet passage having a longitudinal axis which defines a passage plane, said passage plane extending between the longitudinal axis of said wet passage and the part of said outer surface nearest to said wet passage; and said scalloped portion being oriented so that its longitudinal axis lies in said passage plane, said scalloped portion being recessed from said outer surface so that said scalloped portion is not machined when said outer surface is machined.

2. A sealed machined member as set forth in claim 1 wherein said block member is fixed to an engine block so that said block member supports a crankshaft and said outer surface has a transverse orientation with respect to the axis of the crankshaft, said outer surface being sufficiently machined so that the counterweight of the crankshaft, during rotation of the crankshaft, does not contact said outer surface.

3. A sealed machined member as set forth in claim 1 wherein said scalloped portion is concave.

* * * * *